US006439270B1

(12) United States Patent
Chen

(10) Patent No.: US 6,439,270 B1
(45) Date of Patent: Aug. 27, 2002

(54) LIGHT WEIGHT AND FAST DRYING WARP WEAVING FABRIC CAPABLE OF UNIFLOW ABSORBING AND DISPERSING PERSPIRATION

(76) Inventor: Mei-Hua Chen, 5F, No. 30, Sec. 1, Chung-Cheng Rd., Taipei (TW)

( * ) Notice: Subject to any disclaimer, the term of this patent is extended or adjusted under 35 U.S.C. 154(b) by 146 days.

(21) Appl. No.: 09/750,057

(22) Filed: Dec. 29, 2000

(51) Int. Cl.[7] ..... D03D 15/00
(52) U.S. Cl. ..... 139/420 A; 139/383 R
(58) Field of Search ..... 139/383 R, 420 R

(56) References Cited

U.S. PATENT DOCUMENTS 3,654,884 A * 4/1972 Dawbarn ..... 112/410
3,788,364 A * 1/1974 Dawbarn ..... 112/410
4,556,602 A * 12/1985 Williams ..... 139/420 R

* cited by examiner

*Primary Examiner*—John J. Calvert
*Assistant Examiner*—Robert H. Muromoto, Jr.
(74) *Attorney, Agent, or Firm*—Bacon & Thomas

(57) ABSTRACT

A light weight and fast drying warp weaving fabric that is capable of absorbing and dispersing perspiration in one direction is fabricated by warp or weft yarns made from P.P. or PVC fibers or yarns having water absorption and dispersion capability, low water content and low specific weight, and weft or warp yarns made from natural fibers, or synthetic fibers having high water absorption and dispersion capability. The weft yarns of the fabric are linear while the warp yarns are undulantly threaded around the weft yarns such that the warp yarns contact a person's skin and the weft yarns are remote from the skin. The warp yarns absorb perspiration from the skin and transport the moisture to the weft yarns so that the warp yarns keep the skin dry and comfortable, while the moisture in the weft yarns is dispersed and vaporized for fast drying.

1 Claim, 2 Drawing Sheets

LIGHT WEIGHT AND FAST DRYING WARP WEAVING FABRIC CAPABLE OF UNIFLOW ABSORBING AND DISPERSING PERSPIRATION

BACKGROUND OF THE INVENTION

This invention relates to a warp weaving fabric and particularly a warp weaving fabric that has the capability of absorbing and dispersing perspiration in one direction to achieve fast drying, and is especially suitable for making jeans.

The techniques of fabricating "Perspiration dispersing fabric" which can absorb moisture in one direction and keeps human body dry are known in the art. One of such fabrics is fabricated by plain weaving the staple fiber of relatively high denier with staple fiber of relatively low denier. When the resultant fabric is put to use, the high denier staple fiber portion is disposed to face human skin and the low denier staple fiber portion is to face the outer side remote from the skin. As the high denier staple fiber has weaker capillary effect than the lower denier staple fiber, it will disperse moisture and perspiration from the skin to the outer side of the fabric without the moisture flowing reverse.

The foregoing technique is feasibly in principle. However in practice, the attempt of using capillary effect to disperse moisture from one side of the fabric to another side has difficulty. One of the issues is that the staple fibers being used are mostly made from nylon, polyester, acrylic or the like. Their capability of absorbing moisture is generally weaker than natural fiber such as cotton.

Secondly, fabric made by plain knitting usually consists of interwoven warp yarns and weft yarns, and has only a single layer texture. It does not have sufficient thickness to generate the "capillary effect" desired. The capillary effect cannot be fully developed by the fabric made solely from the fibers of different denier.

Thirdly, denier is merely an index number for measuring fiber thickness. Fibers of different deniers but made from same material differ only in size, their physical property substantially remain unchanged. For instance, Polypropylene (P.P.) fiber has low water content (about 0.04). Hence fabric made from P.P. fibers of two different deniers has difficulty to channel moisture from fiber of one size to fiber of another size. This is because moisture absorption and dispersion property is mainly determined by physical property of the fibers not by their size. Therefore the prior art of using fiber of different denier made from same material to fabricate fabric cannot effectively achieve the uniflow perspiration or moisture dispersing function.

Hence for fabricating a fabric that is capable of dispersing perspiration in one direction, the fabric should be woven by materials of different water content. The following is water content figures for the commonly used weaving materials:

| Fiber material | Water content |
|---|---|
| P.P. (Polypropylene) | 0.04 |
| Polyester | 0.4 |
| Acrylic | 1.6 |
| Nylon | 4.5 |
| Cotton | 8 |
| Rayon | 12 |
| Wool | 15 |

SUMMARY OF THE INVENTION

It is therefore an object of this invention to provide a warp weaving fabric that is capable of dispersing perspiration outside the clothing and keeping dry feeling contact with the skin of human body.

Another object of this invention is to provide a fabric in which the warp and welt yarns may be interchanged.

A further object of this invention is to use material of low water content and light weight (such as P.P.) and material of good water absorption (such as cotton, rayon and the like) for weaving the fabric. Conventional cotton fabric tends to produce wrinkle and becomes tacky, damp and not easy to dry when wetted. On the other hand, fabric made from P.P. has the good quality of cotton fabric but without its shortcomings. Furthermore P.P. is environmental friendly and may be decomposed or becomes brittle for disintegration when exposed to sun light (ultra violet light) for a prolong period of time.

In one aspect, the fabric of this invention is made by warp weaving of P.P. fibers or yarns which have water absorption and dispersion capability and low water content and low specific weight property, and fibers or yarns of good water absorption capability and high water content property (hereinafter called A yarns). The P.P. fibers or yarns are used for warp and are woven in an undulant form in cross section. The A yarns are used for weft and are woven linearly. The texture of the finished fabric has the warp yarns located at the inner side to contact the skin, while the weft yarns are located at the outer side. Hence when people perspire, the P.P. yarns absorb the moisture and the disperse it. In the mean time, the A yarns absorb the moisture from the P.P. yarns rapidly because of siphonic effect. Thus the P.P. yarns may constantly maintain a low water content condition and wearer's skin will have dry and comfort feeling. The A yarns will disperse moisture to the atmosphere through air circulation or heat in the air, whereby to make the clothes dry fast and easily.

As a result, this invention provides a single layer fabric which has uniflow perspiration dispersing effect without the more complex woven fabric which have two layers or double side texture for achieving same purpose. Fabric production of this invention is also easier.

BRIEF DESCRIPTION OF THE DRAWINGS

The invention, as well as its many advantages, may be further understood by the following detailed description and drawings, in which.

DESCRIPTION OF THE PREFERRED EMBODIMENT

Figure 2:
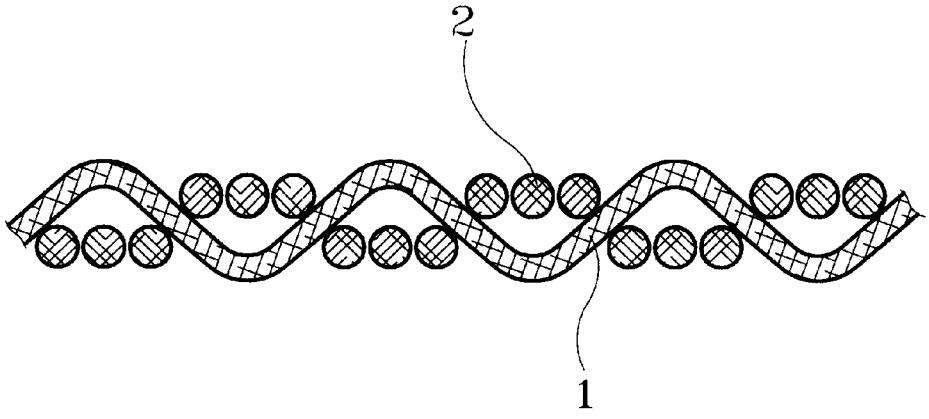
FIG. 2 is a fragmentary amplified cross section of the texture of the fabric of this invention.
Figure 1:
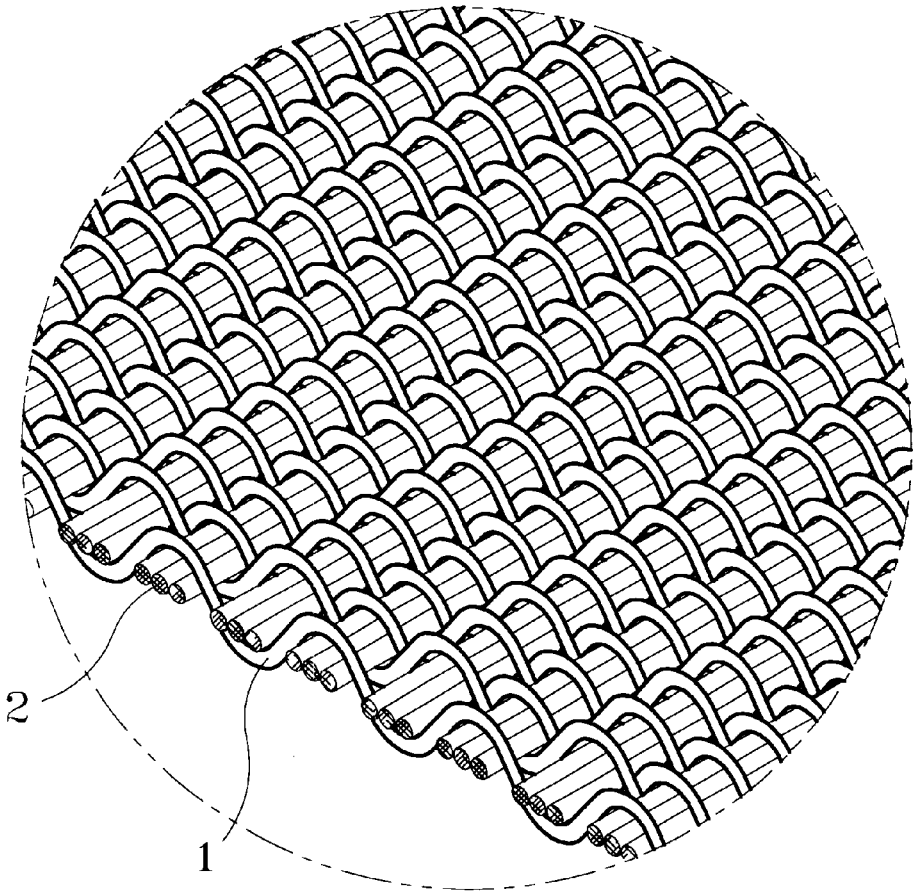
FIG. 1 is a fragmentary amplified view of the texture of the fabric of this invention.
Figure 3:
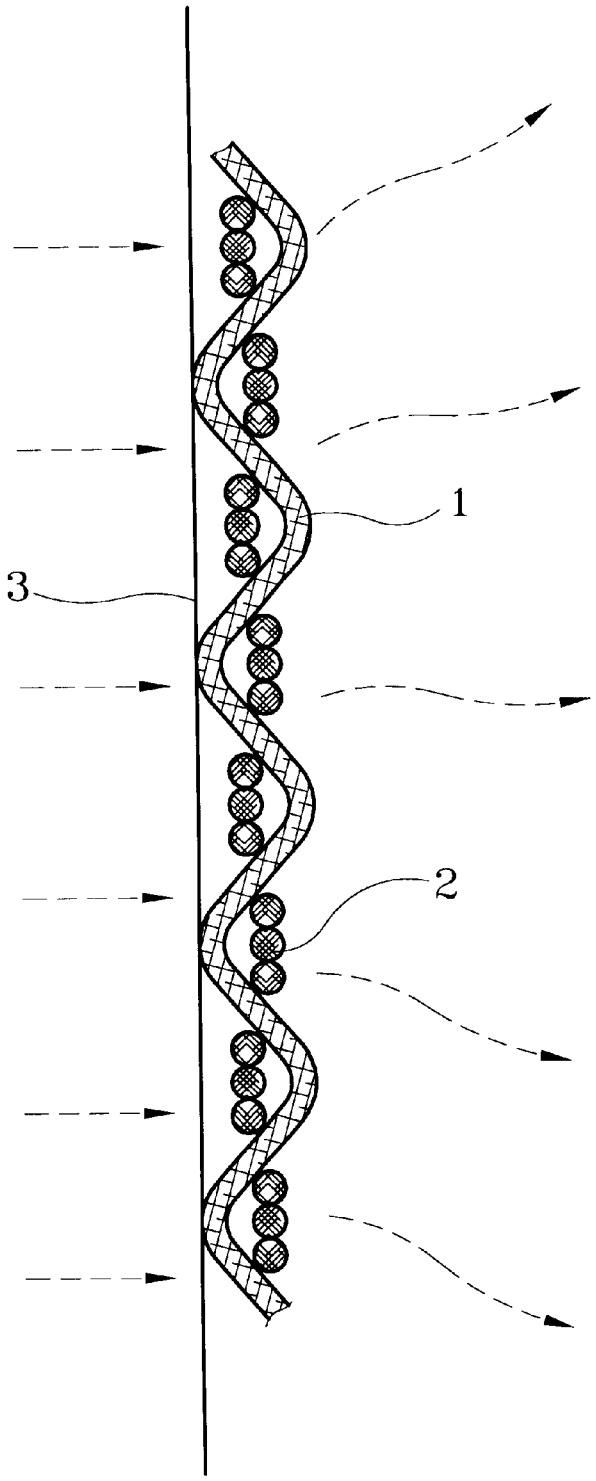
FIG. 3 is a fragmentary schematic view of this invention, showing perspiration dispersing function.

Referring to FIG. 1, the fabric of this invention is fabricated by warp weaving technique and includes weft yarns 2 or warp yarns consisted of fibers or yarns which have high water absorption and dispersion capability (made from materials such as natural fibers, manmade fibers, synthetic fibers and the like, and hereinafter called A yarns), and warp yarns 1 or weft yarns consisted of fibers or yarns which have water absorption and dispersion capability and low water content and low specific weight property (such as P.P. yarns, PVC fibers or yarns). The weft yarns 2 are formed linearly in the fabric texture while the warp yarns 1 are formed in an undulant fashion threading around the weft yarns 2 in the fabric texture (as shown in FIG. 2). When making clothes, the warp yarns 1 portion mostly contact human skin 3 (as shown in FIG. 3).

The two different fibers or yarns may be used for either the warp yarns 1 or weft yarns 2. In the fabric texture fabricated by warp weaving, the warp yarns 1 may be the ones which have water absorption and dispersion capability and low water content and low specific weight property, and be woven mostly at the inner layer to contact the skin. The weft yarns 2 may be yarns which have high water absorption and dispersion capability and be located at the outer layer. When people sweat, P.P. yarns absorb the moisture rapidly and transport the moisture to the A yarns through the siphonic effect so that P.P. yarns always maintain low water content state and are able to make the skin feel dry and comfortable. In the mean time, A yarns will disperse the moisture to the atmosphere through air circulation or heat in the air, whereby to make the clothes dry fast and easily.

The clothing made from natural fibers, manmade fiber fibers, and synthetic are generally more comfortable than those made from the chemical fibers such as nylon, polyester or acrylic, and have better warm keeping property. Hence the fabric made by this invention has better practicability than the fabric made by the prior art.

In another aspect, the warp and weft yarns used in this invention are interchangeable. For instance, the fibers or yarns which have high water absorption and dispersion capability may be woven at the inner layer for contact with the skin, and the fibers or yarns which have water absorption and dispersion capability and low water content and low specific weight property be woven at the outer layer. The fabric thus made may absorb sweat on the skin rapidly and achieve fast perspiration dispersing and drying effect.

What is claimed is:

1. A light weight and fast drying warp weaving fabric capable of uniflow perspiration absorbing and dispersing, comprising:

warp yarns consisting of fibers or yarns which have water absorption and dispersion capability and low water content and low specific weight property made from polypropylene fibers or polyvinyl chloride fibers or yarns; and weft yarns consisting of fibers or yarns which have high water absorption and dispersion capability made from natural fibers, or synthetic fibers;

wherein the weft yarns are formed linearly in the fabric texture, and the warp yarns are formed in an undulant manner threading around the weft yarns such that the warp yarns contact the skin of human body for absorbing perspiration into the fabric and the absorbed perspiration is dispersed to an outer side of the fabric that does not contact the skin.

* * * * *